United States Patent [19]

Saito et al.

[11] Patent Number: 5,023,146

[45] Date of Patent: Jun. 11, 1991

[54] BLACK SURFACE-TREATED STEEL SHEET

[75] Inventors: Katsushi Saito; Yujiro Miyauchi; Toshimichi Murata; Yoshio Shindo, all of Kimitsu, Japan

[73] Assignee: Nippon Steel Corporation, Tokyo, Japan

[21] Appl. No.: 496,334

[22] Filed: Mar. 20, 1990

Related U.S. Application Data

[62] Division of Ser. No. 301,240, Jan. 24, 1989, Pat. No. 4,968,391.

[30] Foreign Application Priority Data

| | | | |
|---|---|---|---|
| Jan. 29, 1988 | [JP] | Japan | 63-17467 |
| Jun. 27, 1988 | [JP] | Japan | 63-158267 |
| Sep. 2, 1988 | [JP] | Japan | 63-219735 |

[51] Int. Cl.[5] ..... C22C 15/08

[52] U.S. Cl. ..... 428/623; 428/626; 428/632; 428/639; 428/659

[58] Field of Search ..... 428/659, 614, 626, 935, 428/623, 632, 639

[56] References Cited

U.S. PATENT DOCUMENTS

| | | | |
|---|---|---|---|
| 4,407,899 | 10/1983 | Hara et al. | 428/626 |
| 4,479,832 | 10/1984 | Hart et al. | 428/659 |
| 4,654,394 | 4/1987 | Hara et al. | 428/626 |
| 4,707,415 | 11/1987 | Ikeda et al. | 428/621 |
| 4,800,134 | 1/1989 | Izaki et al. | 428/659 |
| 4,826,160 | 10/1989 | Shindov et al. | 428/659 |
| 4,891,273 | 1/1990 | Odashima et al. | 428/626 |
| 4,904,545 | 2/1990 | Sugiyama et al. | 428/659 |
| 4,908,279 | 3/1990 | Yosuke et al. | 428/659 |
| 4,910,095 | 3/1990 | Izaki et al. | 428/659 |

FOREIGN PATENT DOCUMENTS

| | | | |
|---|---|---|---|
| 174014 | 3/1986 | European Pat. Off. | 428/659 |
| 54-112731 | 4/1979 | Japan | 428/626 |
| 60-121275 | 6/1985 | Japan . | |
| 60-138093 | 7/1985 | Japan | 428/659 |
| 60-190588 | 9/1985 | Japan . | |
| 60-200996 | 10/1985 | Japan . | |
| 61-30683 | 2/1986 | Japan | 428/659 |
| 61-110798 | 5/1986 | Japan . | |
| 61-152444 | 7/1986 | Japan | 428/659 |
| 64-26438 | 1/1989 | Japan | 428/659 |

OTHER PUBLICATIONS

Interfinish '84, pp. 85–93, 1984, F. Barth et al.

*Primary Examiner*—John J. Zimmerman
*Attorney, Agent, or Firm*—Kenyon & Kenyon

[57] ABSTRACT

Disclosed are a black surface-treated steel sheet, which comprises a steel sheet or plated steel sheet and a electrodeposited composite plating coating formed in a deposition amount of 0.1 to 5 g/m$^2$ on the surface of the steel sheet or plated steel sheet, the plating coating containing metallic zinc or Zn—Ni alloy and oxides or hydrous oxides and sulfur compound, and a process for the preparation of a black surface-treated steel sheet, which comprises carrying out the electrolysis in an acidic aqueous solution containing $Zn^{2+}$ and, as the main components, at least one member selected from the group consisting of $Fe^{2+}$, $Co^{2+}$ and $Ni^{2+}$, and oxidative ion, and a thio compound, by electrolysis a steel sheet or plated steel sheet as the cathode, and water-washing and drying the treated steel sheet.

7 Claims, 5 Drawing Sheets

BLACK SURFACE-TREATED STEEL SHEET

This is a division of application Ser. No. 07/301,240 filed Jan. 24, 1989, now U.S. Pat. No. 4,968,391.

BACKGROUND OF THE INVENTION (1) Field of the Invention

The present invention relates to a black surface-treated steel sheet and a process for the preparation thereof. More particularly, the present invention relates to a black surface-treated steel sheet used for a member to be decorated, and a process for the preparation thereof.

(2) Description of the Related Art

Development of a high-performance surface-treated steel sheet at a low cost is a consistent requirement in the fields of anti-corrosive steel sheets for automobiles, household steel sheets, furniture and construction materials, and the requirement standards have become more severe, and further, a reduction of the cost and an enhancement of the quality are needed. The steel makers have met these users' requirements by developing new techniques and new products, and in the field of products previously prepared by processing a surface-treated steel sheet and pre-treating and coating the steel sheet, serious attempts has been made to introduce a pre-coated steel sheet to this process, to provide high-quality products at a low cost and allow the pre-treating and coating steps by the user to be omitted. Accordingly, a pre-coated steel sheet obtained by coating a steel sheet with a paint has been used, but the requirement for steel sheets colored with an inorganic system is increasing in view of the appearance, weldability, and a prevention of scratches formed during handling.

Black is the most widely-demanded color, and further, there is a demanded for a fingerprint-proof property and a mass productivity, chemical resistance, and corrosion resistance.

Stainless steel sheets, steel sheets, and copper sheets are generally used in the conventional blackening treatment method, but in view of the cost and corrosion resistance, a zinc-plated steel sheet is preferable, to meet the above-mentioned requirements. Accordingly, the conventional blackening techniques using this zinc-deposited steel sheet will be described.

The following techniques are known as methods of blackening zinc-plated or zinc alloy-plated steel sheets by cathodic electrolysis.

Japanese Unexamined Patent Publication No. 60-190588 discloses a method in which the cathodic electrolysis is carried out at 1 to 50 A/dm$^2$ for 0.5 to 30 seconds in an aqueous solution of an alkali metal salt of sulfuric acid, nitric acid, hydrochloric acid, phosphoric acid or carbonic acid, a telluric acid or organic acid salt, or an alkali metal or ammonium salt of thiocyanic acid, thiosulfuric acid or hypophosphorous acid, which contains $CO^{2+}$ or $Ni^{2+}$ and is maintained at a pH of 2 to 11.

This method, however, is not fully satisfactory and involves many problems. During tracing experiments of the method of Japanese Unexamined Patent Publication No. 60-190588, conducted by the present inventors, it was found that blackening is possible in the ideal state of using a stationally bath in a laboratory, but the method cannot be applied to the high-speed treatment of a broad hoop, as intended in the present invention, because an uneven appearance is caused.

Japanese Unexamined Patent Publication No. 61-143594 discloses a method for the production of a black steel sheet, which comprises subjecting a steel sheet, plated with an alloy of an element of the iron group and zinc, to anodic electrolysis in an aqueous solution containing an anion such as $NO_3^-$ or $SO_4^{2-}$. It is taught in this patent publication that, in view of the corrosion resistance and the like, a structure formed by applying a chromate coating or transparent organic resin on the obtained black coating is preferred.

Japanese Unexamined Patent Publication No. 58-151491 discloses a blackening method in which electroplating is carried out in a zinc-plating solution containing Co, Ni or Mo, anodic electrolysis is carried out in an aqueous solution containing $NH_4^+$ to form an inorganic black coating and, if necessary, the black coating is covered with a silicate coating.

The anodic oxidation method is a technique in which a blackening can be carried out only on a specific plating such as Zn-Ni alloy, compared with cathodic method. Further, the anodic oxidation method has insufficient corrosion resistance since the plated coating is remelted and its production cost is expensive.

Japanese Unexamined Patent Publication No. 60-200996 discloses a method in which a black zinc alloy-plated coating containing at least 15% of Ni is formed by cathodic electrolysis in an Ni/Zn alloy-plating solution.

These methods, however, are unsatisfactory in that there are problems with the production and the products fail to meet market requirements. For example, the method in which the plating is re-dissolved is disadvantageous from the viewpoint of cost, and since a waste water treatment is necessary, the plating is limited to alloy-plating. This problem is solved by the cathodic treatment, but unevenness easily occurs. Furthermore, when a broad hoop is treated at a high speed, various appearance defects such as color unevenness are observed and the yield is reduced.

Also with respect to quality, the conventional techniques have the following problems.

As pointed out hereinbefore, a surface-treated steel sheet blackened with an inorganic system is in practical use and the demand for this steel sheet has increased. Nevertheless, the following performance improvements are required:

(1) Since the steel sheet is used not only as an interior sheet but also as a part close to an exterior sheet, a stable and uniform hue and a gloss-controlled high-grade black appearance are necessary.

(2) In view of the demand in the field of electronic appliances, a higher electric conductivity is required.

(3) In the field of office machines utilizing light, a further reduction of reflectance is needed.

According to the conventional techniques, to improve the corrosion resistance and other characteristics, an insulative clear organic resin or silicate coating having a thickness of 1 to 3 $\mu$ is formed as the topcoat, and accordingly, although a satisfactory electric conductivity is maintained upon application of a certain voltage, as at a welding step, the electric conductivity is unsatisfactory in electronic appliances using a low voltage.

As the means for attaining a low reflectance, a clear coating formed by using a delustering silica has been proposed, but a proper balance must be maintained between the thickness of the coating and the size of silica particles, and a gloss and a scratch resistance are not compatible factors. Particularly in the case of copying machines, a reduction of the reflectance is extremely desirably because a high reflectance reduces the copying precision.

In connection with the productivity, as pointed out hereinbefore, in the conventional methods, to blacken a large quantity of a broad hoop, the line speed is reduced and the frequency of exchange of the plating solution is increased to stabilize and uniformalize the hue, even if the composition of the plating, the flow rate of the plating solution, and the composition of the plating solution are changed.

SUMMARY OF THE INVENTION

A primary object of the present invention is to provide a black surface-treated steel sheet, and a process for the preparation thereof, in which the above-mentioned defects are eliminated.

Another object of the present invention is to provide a black surface-treated steel sheet having a low reflectance, excellent appearance, and processability, a high corrosion resistance and scratch resistance, and a process for the preparation of this black surface-treated steel sheet.

Still another object of the present invention is to provide a black surface-treated steel sheet having a controlled color unevenness by blackening a broad hoop, and a process for the preparation thereof.

In accordance with one aspect of the present invention, there is provided a black surface-treated steel sheet which comprises a steel sheet or plated steel sheet and a composite plating cathode electro deposit coating formed in a deposition amount of 0.1 to 5 g/m$^2$ on the surface of the steel sheet or plated steel sheet, said plating cathode electrodeposit coating containing, dispersed therein, an oxide or hydrous oxide of a metal and a sulfur compound.

In accordance with another aspect of the present invention, there is provided a black surface-treated steel sheet or plated steel sheet comprising, a composite electroplating cathode electrodeposit coating formed in a deposition amount of 0.1 to 3 g/m$^2$ on the surface of the steel sheet or plated steel sheet, said composite electroplating containing, metallic zinc, zinc-alloy dispersed, oxides or hydrous oxides of metal and sulfur compounds, a chromate coating formed in a deposition amount of 10 to 100 mg/m$^2$ as Cr on the composite plating coating and a protective coating having a thickness of 0.1 to 0.3 $\mu$m.

In accordance with still another aspect of the present invention, there is provided a process for the preparation of a black surface-treated steel sheet, which comprises carrying out an electrolysis in an acidic aqueous solution containing $Zn^{2+}$ and, as the main components, at least one member selected from the group consisting of $Fe^{2+}$, $Co^{2+}$ and $Ni^{2+}$, an oxidative ion and a thio compound, by using a steel sheet or plated steel sheet as the cathode, and water-washing and drying the treated steel sheet.

In accordance with still another aspect of the present invention, there is provided a process for the preparation of a black surface-treated steel sheet, which comprises carrying out an electrolysis in an acidic aqueous solution containing $Zn^{2+}$ in an amount of 50 to 300 g/l as the sulfate and, as the main components, at least one member selected from the group consisting of $Fe^{2+}$, $Co^{2+}$ and $Ni^{2+}$ in an amount of 50 to 300 g/l as the sulfate, an ion selected from the group consisting of $Cr^{3+}$, $Fe^{2+}$, $Pb^{2+}$, $Ag^{2+}$, $Sn^{2+}$, $Ti^{2+}$, $Al^{3+}$, $Cu^{2+}$, $Cr^{6+}$, $Mo^{6+}$, $V^{6+}$, $Mn^{6+}$ and $Bi^{2+}$ in an amount of 0.01 to 20 g/l, an oxidative ion in an amount of 1 to 20 g/l and a thio compound in an amount of 0.1 to 50 g/l, by using a steel sheet or plated steel sheet as the cathode, and water-washing and drying the treated steel sheet.

BRIEF DESCRIPTION OF THE DRAWINGS

FIG. 1 is a diagram of a section of the black surface-treated steel sheet

DESCRIPTION OF THE PREFERRED EMBODIMENTS

Figure 1A:
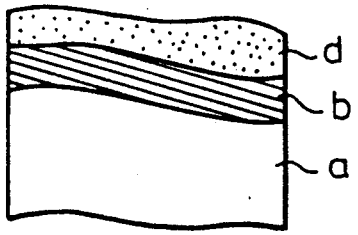
FIG. 1A shows an embodiment in which a chromate coating is not formed and FIG. 1B shows another embodiment in which a chromate coating is formed.
Figure 1B:
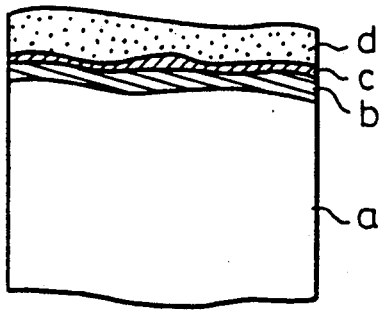

The coating structure of the black surface-treated steel sheet of the present invention is diagrammatically illustrated in FIG. 1. FIGS. 1A and 1B are diagrams illustrating two embodiments of the black surface-treated steel sheet of the present invention. In the drawings, a represents a steel sheet or plated steel sheet (under metal), b represents a black inorganic coating (electrodeposited black coating), c represents a chromate coating, and d represents a resin coating (guard coating) in which black fine particles are dispersed.

To obtain a black appearance with one coating, the concentration of a black pigment and the coating thickness must be increased, and in the case of a coating having a thickness of 0.2 to 3 $\mu$, it is very difficult to obtain a good degree of coloration and a good even coloration. In contrast, in the case of a thick coating, the performance of the product is influenced by the characteristics of the organic resin per se, and the intended characteristics such as weldability, scratch resistance, and fingerprint resistance are degraded. By controlling the thickness of the organic resin to less than 3 $\mu$, excellent characteristics are obtained by the synergistic effect with the inorganic coating including the undercoating plating layer. In the present invention, the problems of the conventional techniques are solved by forming a electrodeposited black coating b as the undercoat and forming a black organic resin coating d as the topcoat, if necessary, after forming a chromate coating c.

Where the organic coating as the topcoat is transparent, the electrodeposited black coating as the undercoat must have a uniform colored appearance, and this results in a reduction of the productivity and yield. Nevertheless, it has been found that, if a slightly blackened coating (practically a light gray coating because the thickness is small and the concentration is low) is formed as the topcoat, the allowable range of the color of the undercoat can be made much wider. As pointed out above, color unevenness occurs in the black coating as the topcoat because the thickness is small, but this color unevenness is compensated by the electrodeposited black coating as the undercoat, and a uniform appearance is obtained by a combination of both coatings. In the present invention, preferably the blackening degree (generally expressed by the L value) of the coating as the topcoat is lower (the L value is larger) than that of the electrodeposited black coating as the undercoat. More specifically, preferably the L value of the lower black inorganic coating is smaller than 20 and the L value of the upper coating is 20 to 30 when coated on a white sheet formed by an electric zinc deposition.

A reduction of the electric resistance of the upper coating, which is difficult in the conventional techniques, can be obtained by dispersing electro-conductive fine particles, and a black surface-treated steel sheet showing an excellent electric conductivity under a low voltage can be obtained in a high yield. Note, the particle size and content of the black fine particles are important for a reduction of the reflectance.

As shown in FIG. 1A, the upper coating is a coating d comprising black fine particles dispersed in an organic resin, and to improve the adhesion and the corrosion resistance, a chromate coating c is formed as the intermediate layer as shown in FIG. 1B. In the embodiment shown in FIG. 1A, preferably an oxide of chromium is contained in the black inorganic coating b as the undercoat.

The respective coatings will now be described.

A steel sheet or plated steel sheet is used as the base metal in the present invention. For example, plated steel sheets are obtained by electroplating or hot dipping zinc, an alloy of zinc with a metal such as Fe, Co, Ni, Al or Sn, tin, aluminum or copper. If the roughness of the surface of the steel sheet is adjusted to an average roughness (Ra) of at least 1 μ, preferably 1.2 to 2.0 μ, the gloss of the product can be reduced and a high-grade appearance can be imparted to the product. In view of the scratch resistance and corrosion resistance, a hard zinc alloy-plated steel sheet is used as the base steel sheet.

Figure 2A:
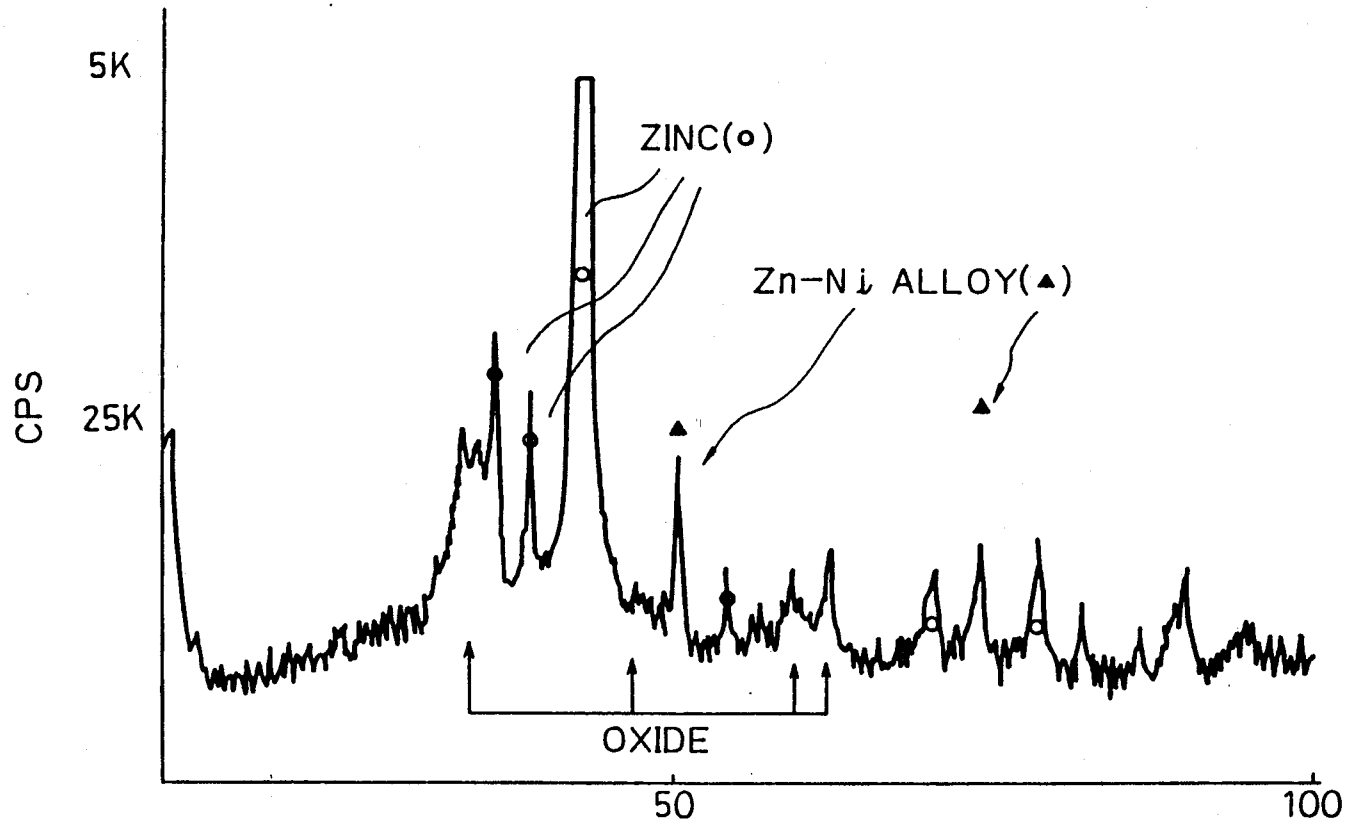
FIG. 2A is a diagram of the results of the X-ray diffractometory of a black inorganic coating deposited from an acidic aqueous solution containing $Zn^{2+}$, $Ni^{2+}$, $NO_3^-$ and $SO_3^{2-}$ and having pH of 2.2 by the cathodic electrolysis, recovered and powdered, wherein peaks corresponding to oxide (ZnO, $Ni(OH)_2$) and metal Zn and Zn-Ni alloy can be detected in the coating.
Figure 2B:
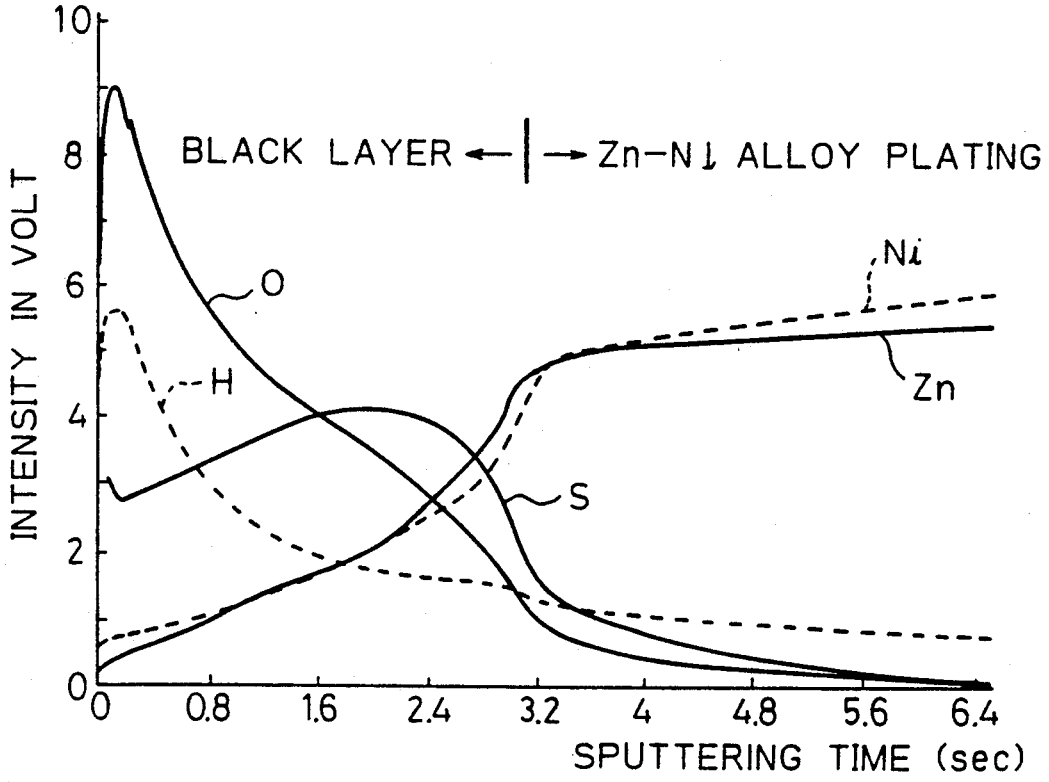
FIG. 2B is a diagram illustrating the results of the Depth-o-profile (composition analysis in the depth direction) analyzed by a glow discharge spectral analysis (G.D.S.) of a black coating obtained by a cathode electrodeposition on a Ni-Zn alloy plated steel sheet in an acidic aqueous solution containing $Zn^{2+}$, $Ni^{2+}$, $NO_3^-$ and $SO_3^{2-}$ and having a pH of 2.0, wherein Zn, Ni O, H and S can be detected in the black coating.

The black inorganic coating must be composed of a black compound and have an excellent adhesion. This black inorganic coating is composed mainly of metal and hydrous oxides of Zn, Fe, Ni, Co, Mn, Mo, Cr, Cu, Bi or V, and sulfides thereof, and is obtained by a cathodic electrolysis. FIG. 2 shows the results of the X-ray diffractometrical qualitative analysis of the peeled powder of a black inorganic coating cathodically deposited on a steel sheet in an aqueous solution containing $Zn^{2+}$, $Ni^{2+}$ and $NO_3^-$. The figure shows that metallic zinc and a hydrous oxide are detected.

Since the coating is formed of the inorganic compound, in view of the black hue and adhesion, preferably the deposition amount is controlled to 0.1 to 3.0 $g/m^2$. An organic resin coating containing organic black fine particles dispersed therein, as described hereinafter, effectively eliminates the appearance unevenness; a defect of the conventional cathodic electrolytic treatment method.

The amount applied of the organic resin coating having black fine particles dispersed therein must be controlled so that the appearance and weldability are not degraded. More specifically, preferably the amount applied of the organic resin coating is such that the thickness is smaller than 3 μm, especially smaller than 1.5 μm. The minimum thickness necessary to ensure a uniformalized appearance, stabilized hue, a good corrosion resistance and scratch resistance, and to fix the black fine particles, is 0.1 μm, preferably 0.5 μm. The optimum thickness of the organic resin coating is from 0.5 to 1.5 μm in the present invention.

The resin (organic polymer) coating is formed by coating a water-soluble, water-dispersible or solvent-soluble organic polymeric compound, if necessary together with a curing agent, and curing the polymeric compound by baking or the like; by curing with ultraviolet rays; or by coating a polymer combined with an inorganic or organic compound, if necessary together with a curing agent, and curing the combined polymer by baking or the like. As the compound combined with the organic polymer, there can be mentioned fine particles, preferably sols, of oxides such as silica, titania, alumina, and zirconia, inorganic compounds such as mica, talc, phosphates, borates, and chromates, organic compounds such as fatty acid soaps, fatty acid esters, and pulverized plastics, and organic metal compounds such as silane coupling agents and titanium coupling agents. Since the thickness of the guard coating (protective coating) is small, as described hereinafter, the combined compound is preferably used in the form of fine particles (particle size, 1 to 100 nm), and the combined compound uniformly dispersed in the resin.

Most preferably carbon black is used as the black fine particles to be dispersed in the resin, and the particle size is selected in accordance with the intended hue and gloss. A commercially available carbon black having a particle size of 50 to 200 nm can be used. Fine carbon black having a particle size smaller than 50 nm has a high blackening capacity but does not reduce the gloss but rather increases same. Accordingly, this carbon black has an adverse effect on the required reduction of the gloss, as intended in the present invention. Where carbon black having a particle size exceeding 200 nm is used, a uniform appearance is difficult to obtain, precipitation of the carbon black in a paint occurs, and the scratch resistance is degraded. Practically, a commercially available dispersion comprising dispersed carbon black is used. The particle size of carbon black can be measured and controlled by using a spectral analyzer utilizing scattered laser beams. In view of the reflectance, the hue and evenness of the appearance, and the electric conductivity, the amount of carbon black added is adjusted so that the carbon black/resin weight ratio is at least 15/100, preferably at least 20/100. If this weight ratio is lower than 15/100, the gloss-reduction effect is poor. If the carbon black content is too high, particles of carbon black break through the resin coating, due to a secondary agglomeration of the carbon black, with the result that scratching or powdering occurs and the adhesion and corrosion resistance are degraded. Accordingly, the weight ratio of carbon black to the resin is preferably from 15/100 to 40/100, more preferably from 20/100 to 30/100.

As the black fine particles, oxides, sulfides, and carbides of Fe, Co, Ni, Cu, Mn, Mo, Ag, and Sn, and black metal fine powders can be used, as well as carbon black.

In the present invention, if an oxide of chromium is incorporated in the black inorganic coating according to the preferred embodiment, a resin coating having black fine particles dispersed therein can be directly formed and the chromate coating omitted, as shown in FIG. 1A. As the method for incorporating an oxide of chromium in the black inorganic coating, there can be mentioned a method in which $Cr^{3+}$ is added to a black cathodic treatment solution. The most suitable properties can be obtained by water washing after the blacking treatment and carrying out a chromate treatment before the guard coating. As the chromate treatment, there can be mentioned a coating-drying chromate treatment method, a reactive chromate treatment method comprising dipping or spraying and subsequent water washing, and an electrolytic chromate treatment method.

Since a black inorganic coating is formed by a metal zinc composite plating in which oxide and/or a sulfur compound are dispersed, a decoloring of the black coating may occur during the etching with a chromate having a high acidity. Accordingly, the pH of the chromate solution is preferably 1 to 5. A coating type chromate is obtained by applying an aqueous solution of a water-soluble compound of $Cr^{3+}$ or $Cr^{6+}$, preferably chromic anhydride or chromic acid partially reduced so that the $Cr^{3+}/Cr^{6+}$ ratio is 0.1 to 0.5, or a composite chromate treatment solution formed by adding a composite component such as silica sol, phosphoric acid or an organic polymeric compound to the above solution, on the black coating, and immediately forcibly drying the coating at 60° to 100° C. The reactive chromate is obtained by using a commercially available treating solution comprising a chromic acid compound and an anionic compound. The electrolytic chromate is obtained by carrying out the cathodic electrolysis in a chromic acid aqueous solution comprising chromic acid and an anion as the main components and having a pH value of 1.0 to 5, followed by water washing.

The amount of deposition of the chromate coating is adjusted to 10 to 200 mg/m$^2$ as calculated as Cr. If the deposition amount exceeds 200 mg/m$^2$, degradation of the adhesion and contamination of the welding electrode occur due to the cohesive failure of the chromate coating per se. If the deposition amount is smaller than 10 mg/m$^2$, the effect obtained by the chromate coating (improvement of the corrosion resistance and adhesion) is unsatisfactory.

The process for the preparation of a black surface-treated steel sheet according to the present invention will now be described.

The treatment solution used in the present invention is an aqueous solution comprising $Zn^{2+}$ as the indepensable component, and further comprising a metal ion selected from $Fe^{2+}$, $Co^{2+}$ and $Ni^{2+}$ (preferably together with $Cr^{3+}$) and an oxidative ion and a thio compound as the main components. The metal ion is supplied in the form of the sulfate, a chloride, a sulfamate, a metal, a hydroxide, an oxide or a carbonate, and can be automatically supplied from the electrode.

$Zn^{2+}$ is one of the indispensable components and is trapped in the coating to act as the blackening component, and simultaneously, the $Zn^{2+}$ controls the generation of hydrogen gas and contributes to a uniformalization of the appearance. At least one member selected from $Fe^{2+}$, $Co^{2+}$ and $Ni^{2+}$ is an important component for precipitating a compact coating having a high density. If $Zn^{2+}$ alone is contained, a black coating is difficult to obtain, and even if formed, the coating is discolored by reaction with the chromate coating and guard coating, and an unstable coarse coating is formed.

Preferably, the concentration of $Zn^{2+}$ is 50 to 300 g/l as the sulfate, the concentration of the metal ion other than $Cr^{3+}$ is 50 to 300 g/l as the sulfate and the concentration of $Cr^{3+}$ is 0.01 to 10 g/l. Most preferably, the $Zn^{2+}$ concentration is 100 to 200 g/l and the $Zn^{2+}/Ni^{2+}$, $Zn^{2+}/Fe^{2+}$ or $Zn^{2+}/Co^{2+}$ sulfate ratio is from 1/1 to ½. If this ratio is higher than 1/1, discoloration is occurs at the subsequent steps. Namely, the coating is easily discolored by the guard coating or chromate coating. If this ratio is lower than ½, an appearance unevenness occurs due to a generation of hydrogen gas or a change of the flow rate.

To form a uniform black coating, a higher metal ion concentration is preferred, but if the metal concentration is too high, problems such as a drag-out of the coating solution and a precipitation of the salt occur. Accordingly, preferably the metal concentration is within the above-mentioned range.

If the metal ion alone is contained, a black coating can not be formed, and thus an oxidative ion and a thio compound are necessary. The oxidative ion oxidizes a part of the metal in the cathode zone and acts as a component for an electrodeposition of a black composite plating. The thio compound acts as an ion enhancing the blackening effect and improving the uniformity, hue, and adhesion of the black coating.

$NO_3^-$, $NO_2^-$, $ClO_4^-$ and $ClO_3^-$ are preferred as the oxidative ion, and $NO_3^-$ is especially preferred, as this provides a most stable black coating. The concentration of the oxidative ion is preferably 1 to 20 g/l. If the concentration of the oxidative ion is lower than 1 g/l, the blackening degree is poor, and if the concentration of the oxidative ion is higher than 20 g/l, a white compound is precipitated on the surface and an appearance unevenness or insufficient adhesion occurs, and good results cannot be obtained.

The black coating can be formed only by the above-mentioned components, but in this case, sometimes the adhesion is reduced when the chromate treatment or aqueous guard coating treatment described hereinafter is carried out, and thus the application is restricted.

According to the present invention, a thio compound is further added. The thio compound is selected from the group consisting of sulfurous acid ($H_2SO_3$) and salts thereof, thiosulfurous acid ($H_2S_2O_2$) and salts thereof, thiosulfuric acid ($H_2S_2O_3$) and salts thereof, thiocyanic acid (HSCN) and salts thereof, thiocarbonic acid ($H_2CS_3$) and salts thereof, and —SH and —SR compounds such as thiosugar ($C_6O_5H_{11}SH$), thiophene ($H_4C_4S$), thiourea [$SC(NH_2)_2$], thiophenol ($C_6H_5SH$), and thiophthene ($C_6H_4S_2$).

Among the above, sulfites thiocyanides, thiosulfates, and thiourea are preferred.

The amount of thio compound added is 0.1 to 50 g/l, preferably 0.5 to 10 g/l. If the amount of the thio compound is smaller than 0.1 g/l, the effect of the thio compound is not manifested, and if the amount of the thio compound is larger than 50 g/l, a black coating is difficult to obtain and a bad odor is generated during the electrolysis.

In the present invention, a black steel sheet can be obtained by using an aqueous solution containing $Zn^{2+}$ as the first component, a metal ion selected from the group consisting of $Fe^{2+}$, $Co^{2+}$ and $Ni^{2+}$ as the second component, an oxidizing ion, and a thio compound. A black steel sheet having an enhanced quality can be obtained by further incorporating a third metal ion component.

The third metal ion (hereinafter referred to as "modifying ion") is selected from the group consisting of $Cr^{3+}$, $Fe^{2+}$, $Pb^{2+}$, $Ag^{2+}$, $Sn^{2+}$, $Ti^{2+}$, $Al^{3+}$, $Cu^{2+}$, $Cr^{6+}$, $Mo^{6+}$, $V^{6\mu}$, $Mn^{6+}$ and $Bi^{2+}$, and $Cr^{3+}$ and $Fe^{2+}$ are especially effective. $Fe^{2+}$ not only acts as the second metal component but also exerts the following function.

According to the present invention, a black product is prepared by forming a black coating, carrying out a chromate treatment, if necessary, and then forming a guard coating. Where a black coating is obtained from an aqueous solution containing the modifying ion, the modifying ion is co-precipitated with the precipitated metal or compound and reacts with the chromate coating and guard coating to give a black steel sheet having an enhanced adhesion and black appearance. Especially, where an emulsion comprising a hydrophilic resin is used for forming the guard coating, good results are obtained by the reaction of the modifying ion with a hydrophilic group (such as a carboxyl group, a hydroxyl group or an amino group) contained in the resin structure.

The concentration of the modifying ion is 0.01 to 10 g/l, preferably 0.1 to 1.0 g/l, for $Cr^{3+}$, and 1 to 20 g/l for $Fe^{2+}$. In the case of other modifying ions, the concentration is 0.001 to 1 g/l. Note, $Pb^{2+}$, $Fe^{2+}$, and the like can be naturally supplied from the anode or steel sheet.

Preferably, the pH value of the aqueous solution is at least 1, especially 1.5 to 3.0. In the present invention, a black surface can be obtained within a broad pH range of from 0.7 to 6.0, but in view of the quality of the obtained coating, for example, the adhesion or ease of control of the bath concentration, the above-mentioned pH range is preferred. Experiments carried out at bath temperatures of 20° to 80° C. confirmed that a good black coating can be obtained within this temperature range.

Compounds described below can be further added to realize the objects described below, in the present invention. For example, various electrolyte can be added to increase the electro-conductivity of the solution, and a borate, a phosphate, and a phthalate used as the pH buffer agent. Moreover, a polymer can be added to improve the adhesion and processability, and a minute amount of a phosphate or chromic acid can be added to obtain an anti-corrosive effect or improve the adhesion to the guard coating. Furthermore, the black coating can be stabilized by a combination of an inorganic sol compound and a cationic polymer. Still further, a chelating agent can be added to prevent precipitation, and a polymer, a chelate compound, a chloride, a fluorine compound or the like can be added to impart smoothness to the formed composite zinc plating coating.

The electrolysis conditions will now be described.

The process of the present invention is superior to the conventional techniques in that blackening is accomplished in a shorter time and the electrolysis conditions can be selected within a wider range. The current density is preferably 1 to 50 A/dm$^2$. If the current density is lower than 1 A/dm$^2$, blackening is difficult, and if the current density is higher than 50 A/dm$^2$, hydrogen gas is generated and the risk of peeling of the formed coating is high. A black coating having a high quality is obtained when the quantity of applied electricity is 5 to 100 C/dm$^2$. If the electricity quantity is smaller than 5 C/dm$^2$, blackening is difficult and the appearance tends to become uneven. If the electricity quantity exceeds 100 C/dm$^2$, a white coating is co-deposited and hydrogen gas is generated to render the appearance uneven. Preferably, the electrolysis is carried out under the conditions of 20 to 50 C/dm$^2$.

When the electrolysis of the present invention was applied to a cold-rolled steel sheet, a zinc-electroplated steel sheet, a zinc alloy-electroplated steel sheet, a zinc-hot-dipped steel sheet a zinc alloy-hot-dipped steel sheet, a zinc-bright-plated steel sheet, a tin-plated steel sheet, and an aluminum-plated steel sheet, it was found that all of the steel sheets were colored. To form a black coating, a cold-rolled steel sheet and a zinc alloy-electroplated steel sheet (Zn-Ni or Zn-Fe) have an excellent degree of blackening and scratch resistance.

A steel sheet having a black coating is obtained by the above-mentioned treatment, but a steel sheet having an enhanced appearance and performance can be obtained by further forming a guard coat or carrying out the chromate treatment and then forming a guard coating.

The guard coating is formed to further improve the quality. For example, by forming the guard coating, the evenness of the appearance is improved and the coloration degree is increased. For the gloss, a steel sheet having a semi-glossy or glossy appearance can be obtained by adjusting the kind and thickness of the guard coating and controlling the surface roughness of the steel sheet. Furthermore, the resistance to flaws is improved, an excellent pressing processability and bending processability can be imparted to the steel sheet, and the guard coating is especially effective for preventing impart cracks or the like during pressing or handling. Still further, the corrosion resistance is improved by the guard coating.

The guard coating used in the present invention is (1) a resin coating, (2) an inorganic polymer coating, (3) a composite coating of a resin and an inorganic polymer, or (4) a coating of an oil, fat or wax.

The amount of deposition of the guard coating must be such that the appearance and weldability are not degraded, and preferably, the deposition amount is smaller than 3 g/m$^2$, more preferably smaller than 1.5 g/m$^2$.

The guard coating of a resin (organic polymer) is formed by coating a water-soluble, water-dispersible or solvent-soluble organic polymeric compound, if necessary together with a curing agent, and curing the coating by baking or the like, or curing by irradiation of ultraviolet rays, or by coating a polymer combined with an inorganic or organic compound, if necessary together with a curing agent, and curing the coating by baking or the like. As the compound to be combined with the polymer, there can be mentioned fine particles, preferably sols, of oxides such as silica, titania, alumina and zirconia, inorganic compound such as mica, talc, phosphates, borates and chromates, organic compounds such as fatty acid soaps, carbon, fatty acid esters, and plastic particles, and organic metal compounds such as silane coupling agents and titanium coupling agents. Note, since the thickness of the guard coating is small, preferably the compound to be combined is in the form of fine particles (having a particle size of 1 to 100 μm), and the compound is uniformly dispersed in the resin.

As the inorganic polymer, there can be mentioned silicate compounds and sols of sodium silicate and lithium silicate, condensed phosphoric acid polymers, biphosphates, and zirconic acid polymers.

Known oils, fats and waxes can be used.

The black surface-treated steel sheet of the present invention is characterized in that, since the thicknesses of the colored composite plating coating and the guard coating are small, a satisfactory appearance and quality reflecting the surface conditions of the base metal, such as the gloss and roughness, can be obtained.

The present invention will now be described in detail with reference to the following examples. The terms and evaluation methods used in the examples are explained below.

1) Black Appearance

L value:

The L value indicates the lightness (JIS Z-8370). The requirements $L \leqq 20$, preferably $L \leqq 15$, must be satisfied for the black color.

G value:

The gloss is measured at an angle of 60°-60° by using the G value of a black glass sheet, which is 90.1, as the reference value.

Reflectance:

The reflectance is determined at an angle of 45° by using the value of the mirror surface, which is 1000, as the reference value.

Appearance Evenness:

After the formation of a resin coating, the appearance is evaluated by the naked eye, as follows:

5: no unevenness
4: slight unevenness that can be ignored in practice
3: streaky unevenness
2: conspicuous unevenness
1: extreme unevenness Electric Conductivity The electric conductivity of the surface of a black steel sheet is measured by a commercially available two-probe type portable surface resistance meter (Loresta FP supplied by Mitsubishi Yuka) under a spring pressure of 6.5 kg/cm$^2$. The electric conductivity is expressed by the unit of resistance (Ω).

Hue of Appearance

The hue of the appearance is evaluated based on naked eye observation.

N: normal black
R: reddish black
B: bluish black

2) Adhesion

The adhesion is evaluated by the Erichson test. The sample is draw-formed at a depth of 10 mm and peeling is determined by using Cellotape (registered trademark). The adhesion is evaluated based on the peeled area ratio (%).

o: no peeling, peeled area ratio=0%
Δ: spot adhesion, peeled area ratio lower than 1%
x: peeling, peeled area ratio higher than 5%

3) Scratch Resistance

The sample is rubbed with a nickel coin and the scratch resistance is evaluated based on the degree of flaws appearing.

5: substantially no flaws
4: slight traces observed
3: flaws clearly observed
2: flaws having a width of 1 mm
1: flaws having a width of 2 mm or more 4) Corrosion Resistance The continuous salt water spray test is carried out according to JIS Z-2371, and the corrosion resistance is expressed by the time (hours) required for a formation of 5% white rust.

5) Particle Size of Carbon Black

The particle size is measured by a commercially available spectral analyzer utilizing scattered laser beams (Colter Model N4 supplied by Nikkaki), and an average value is taken.

EXAMPLE 1

Cold-rolled steel sheet was subjected to a plating treatment shown in Table 1 by using a Pb anode, and the hoop was immediately subjected to a blackening treatment shown in Table 1 and a guard coating was formed. Baking was carried out at a sheet temperature of 100° C. The results are shown in Table 1. Sample Nos. 1 through 23 were prepared by using a zinc/nickel alloy-plated steel sheet.

Sample Nos. 1, 2, 3 and 4 were comparative samples free of the oxidative ion, and in these comparative samples, a blackening effect was not obtained (L value >20). Sample No. 5 was a comparative sample free of the zinc ion and the oxidative ion, and a black appearance as of the foregoing comparative samples was not obtained.

Sample Nos. 6, 7 and 8 were samples of the present invention. In these samples, a satisfactory black appearance was obtained, but for the adhesion after formation of the guard coating, peeling occurred in the Erichson test.

Sample Nos. 9 through 13 were samples of the present invention where $Cr^{3+}$ was added in an amount of 0.15 to 0.90 g/l, and in each case, a black steel sheet having an excellent appearance and adhesion was obtained. Before the formation of the guard coating, the L value was increased with an increase of the $Cr^{3+}$ concentration, and the degree of blackening was raised by the formation of the guard coating.

Sample Nos. 14 through 17 were samples of the present invention wherein the $Zn^{2+}/Ni^{2+}$ concentration ratio was changed. It was found that a good steel sheet was obtained within a broad concentration ratio range, although the evenness was relatively low if the concentration ratio was low.

The results of sample Nos. 19 and 20 indicated that a broad range could be used for the solution temperature. Sample Nos. 21 through 23 were samples of the present invention where the pH value of the solution was changed in the range of 1.0 to 4.0. At a low pH value, the L value was slightly increased and slight unevenness was caused by a generation of hydrogen.

Sample Nos. 24 through 28 were samples of the present invention obtained by subjecting various plated steel sheets shown in Table 4 to the blackening treatment, and in each sample a good appearance and performance were obtained.

TABLE 1

| Sample No. | Blackening Treatment Solution (g/l)[1] A | B | C | D | E | F | pH | Solution Temperature (°C.) | DK[2] | Q[3] | L Value[4] M-L | T-L | Adhesion[5] | Evenness (naked eye observation)[6] | Steel Sheet[7] | Remarks |
|---|---|---|---|---|---|---|---|---|---|---|---|---|---|---|---|---|
| 1 | 150 | 200 | 1 | 0 | 0 | 0 | 2.0 | 40 | 20 | 25 | 36 | 36 | o | x | Z-N | Comparison |
| 2 | 150 | 200 | 3 | 0 | 0 | 0 | 2.0 | 40 | 20 | 25 | 38 | 37 | o | x | " | " |
| 3 | 150 | 200 | 6 | 0 | 0 | 0 | 2.0 | 40 | 20 | 25 | 37 | 36 | o | x | " | " |
| 4 | 150 | 200 | 6 | 0 | 0 | 0 | 2.0 | 40 | 20 | 200 | 27 | 25 | o | x | " | " |
| 5 | 0 | 200 | 6 | 0 | 0 | 0 | 2.0 | 40 | 20 | 200 | 26 | 26 | o | x | " | " |
| 6 | 150 | 200 | 1 | 1 | 0 | 0 | 2.0 | 40 | 20 | 25 | 11 | 11 | Δ | o | " | Present Invention |
| 7 | 150 | 200 | 1 | 1 | 0 | 0 | 2.0 | 40 | 20 | 25 | 11 | 11 | Δ | o | " | Present Invention |
| 8 | 150 | 200 | 1 | 2 | 0 | 0 | 2.0 | 40 | 20 | 50 | 10 | 9 | Δ | o | " | Present Invention |
| 9 | 150 | 200 | 1 | 2 | 0.15 | 0 | 2.0 | 40 | 20 | 25 | 14 | 11 | o | o | " | Present Invention |
| 10 | 150 | 200 | 1 | 2 | 0.30 | 0 | 2.0 | 40 | 20 | 25 | 16 | 11 | o | o | " | Present Invention |
| 11 | 150 | 200 | 1 | 2 | 0.45 | 0 | 2.0 | 40 | 20 | 25 | 18 | 11 | o | o | " | Present Invention |
| 12 | 150 | 200 | 1 | 2 | 0.60 | 0 | 2.0 | 40 | 20 | 25 | 20 | 11 | o | o | " | Present Invention |
| 13 | 150 | 200 | 1 | 2 | 0.90 | 0 | 2.0 | 40 | 20 | 25 | 20 | 11 | o | o | " | Present Invention |
| 14 | 100 | 100 | 1 | 2 | 0.10 | 0 | 2.0 | 40 | 20 | 25 | 17 | 11 | o | o | " | Present Invention |
| 15 | 100 | 150 | 1 | 2 | 0.10 | 0 | 2.0 | 40 | 20 | 25 | 17 | 11 | o | o | " | Present Invention |
| 16 | 50 | 100 | 1 | 2.0 | 0.10 | 0 | 2.0 | 40 | 20 | 25 | 20 | 17 | o | Δ | " | Present Invention |
| 17 | 300 | 300 | 1 | 3.0 | 0.10 | 0 | 2.0 | 40 | 20 | 25 | 11 | 10 | o | o | " | Present Invention |
| 18 | 150 | 200 | 1 | 2.0 | 0.15 | 10 | 2.0 | 40 | 20 | 25 | 10 | 9 | o | o | " | Present Invention |
| 19 | 150 | 200 | 1 | 2.0 | 0.15 | 0 | 2.0 | 60 | 20 | 25 | 14 | 11 | o | o | " | Present Invention |
| 20 | 150 | 200 | 1 | 2.0 | 0.15 | 0 | 2.0 | 80 | 20 | 25 | 12 | 11 | o | o | " | Present Invention |
| 21 | 150 | 200 | 1 | 2.0 | 0.15 | 0 | 1.0 | 40 | 20 | 25 | 18 | 15 | o | Δ | " | Present Invention |
| 22 | 150 | 200 | 1 | 2.0 | 0.15 | 0 | 3.0 | 40 | 20 | 25 | 11 | 10 | o | o | " | Present Invention |
| 23 | 150 | 200 | 1 | 2.0 | 0.15 | 0 | 4.0 | 40 | 20 | 25 | 10 | 11 | Δ | o | " | Present Invention |
| 24 | 150 | 200 | 1 | 2.0 | 0.6 | 0 | 2.0 | 40 | 20 | 50 | 15 | 11 | o | o | ET | Present Invention |
| 25 | 150 | 200 | 1 | 2.0 | 0.9 | 0 | 2.0 | 40 | 20 | 50 | 16 | 11 | o | o | EG | Present Invention |
| 26 | 150 | 200 | 1 | 2.0 | 0.6 | 0 | 2.0 | 40 | 20 | 50 | 16 | 10 | o | o | AS | Present Invention |
| 27 | 150 | 200 | 1 | 2.0 | 0.9 | 0 | 2.0 | 40 | 20 | 50 | 15 | 11 | o | o | SZ | Present Invention |
| 28 | 150 | 200 | 1 | 2.0 | 0.6 | 0 | 2.0 | 40 | 20 | 50 | 15 | 11 | o | o | ST | Present Invention |

Note
[1]A: $ZnSO_4.7H_2O$
B: $NiSO_4.6H_2O$
C: NaSCN
D: $NaNO_3$
E: $Cr^{3+}$ (sulfate)
F: $FeSO_4.7H_2O$
[2]Dk: current density, $A/dm^2$
[3]Q: applied electricity quantity, $C/dm^2$
[4]L value: The L value was the lightness determined by ZIS Z-8370. The requirement of $L \leqq 20$, preferably $L \leqq 15$, must be satisfied for the black color.
Guard Coating: A composite coating was formed in an amount of 1 $g/m^2$ by a commercially available polyolefinacrylic emulsion and colloidal silica.
M-L: L value before formation of the guide coating
T-L: L value after formation of the guide coating
[5]Adhesion The adhesion was evaluated by the Erichson test. The sample was draw-formed at a depth of 7 mm and peeling was examined by using Cellotape. The adhesion was evaluated based on the peeled area ratio (%).
o: no peeling, peeled area ratio = 0%
Δ: spot adhesion, peeled area ratio lower than 1%
x: peeling, peeled area ratio higher than 5%
[6]Evenness The evenness was evaluated based on the appearance after the blackening treatment.
o: even and aesthetically good
Δ: slight unevenness
x: uneven
[7]Z—N: 12% Ni/Zn alloy electroplating (deposition amount, 15 $g/m^2$) steel sheet
ET: tin-plated (deposition amount, 5 $g/m^2$) steel sheet
ED: zinc-electroplated (deposition amount, 20 $g/m^2$) steel sheet
AS: zinc/iron alloy-galvanized hot-dipped (deposition amount, 40 $g/m^2$) steel sheet
SZ: 5% Al/Zn alloy-hot-dipped (deposition amount, 60 $g/m^2$) steel sheet
ST: cold-rolled steel sheet

EXAMPLE 2

A zinc/nickel alloy-electroplated steel sheet was blackened under the conditions of Example 1 (sample No. 9) and subjected to the chromate treatment under the conditions shown in Table 2, and a guard coating was formed.

Sample Nos. 29 through 33 were samples prepared by the coating type chromate treatment, and the guard coating was formed by an emulsion combined with silica. An excellent appearance and quality were obtained, and the corrosion resistance was good.

Sample Nos. 33 and 34 were samples prepared by the electrolytic chromate treatment and reactive chromate treatment, respectively. The L value was slightly increased, but the quality was good.

Sample Nos. 35 through 37 were samples prepared by forming different guard coatings after the coating type chromate treatment. Sample No. 35 had a relatively poor water resistance and was slightly inferior to other samples with regard to corrosion resistance, but the outer properties were good. Sample Nos. 36 and 37 had a high quality.

TABLE 2

| Sample No. | Blackening Conditions | Chromate Coating[8] Kind | Chromate Coating[8] Cr deposition amount ($mg/m^2$) | Guard Coating[9] Kind | Guard Coating[9] Thickness ($g/m^2$) | L value | Adhesion | Evenness | Corrosion Resistance, SST[10] | Remarks |
|---|---|---|---|---|---|---|---|---|---|---|
| 29 | Conditions of sample No. 9 of Example 8 | A | 30 | G-1 | 1.2 | 10 | o | o | 0 | Present invention |
| 30 | | B | 30 | " | 1.2 | 10 | o | o | 0 | Present invention |
| 31 | | C | 30 | " | 1.2 | 10 | o | o | 0 | Present invention |
| 32 | | D | 30 | " | 1.2 | 10 | o | o | 0 | Present invention |
| 33 | | E | 40 | " | 1.2 | 13 | o | o | 2 | Present invention |
| 34 | | F | 35 | " | 1.2 | 14 | o | o | 2 | Present invention |
| 35 | | A | 35 | G-2 | 1.2 | 11 | o | o | 5 | Present invention |
| 36 | | A | 35 | G-3 | 1.2 | 13 | o | o | 0 | Present invention |
| 37 | | A | 35 | G-4 | 1.2 | 10 | o | o | 0 | Present invention |

Note
[8]A: coating type chromate (pH = 2.3) of partially reduced chromic acid ($CR^{3+}/Cr^{6+}$ ratio = 0.4/0.6)
B: coating type chromate (pH = 2.3) of partially reduced chromic acid/silica sol (= 1/1)
C: coating type chromate (pH = 2.0) of partially reduced chromic acid/polyacrylic acid (= 1/0.1)
D: coating type chromate (pH = 2.5) of partially reduced chromic acid/ammonium phosphate (= 1/0.1)
E: cathodically electrolyzed chromate (pH = 4.0) of $Na_2Cr_2O_7/H_2SO_4$ (= 50/0.2)
F: reactive chromate (pH = 1.8) of $ZnCr_2O_7/H_3SO_4$ (= 30.3)
[9]G-1: coating of ethylene-imene/acrylic acid emulsion combined with silica sol
G-2: lithium silicate
G-3: urethane-epoxy clear coating
G-4: resin coating of urethane emulsion combined with silica sol
[10]Corrosion Resistance During the salt water spray test (SST) according to JIS Z-2371, the corrosion resistance was evaluated based on the ratio (%) of the area over which white rust was generated after 168 hours.

EXAMPLE 3

A zinc/nickel alloy-plated steel sheet was blackened by the electrolysis conducted at DK of 10 $A/cm^2$ and Q of 30 $C/dm^2$ in a blackening treatment solution obtained by adding an oxidizing ion shown in Table 6 and a thio compound shown in Table 6 to a base solution containing 150 g/l of zinc sulfate and 200 g/l of nickel sulfate (ZN-Ni) or 150 g/l of zinc sulfate, 150 g/l of nickel sulfate and 50 g/l of cobalt sulfate (ZN-Ni-CO) maintained at a pH value of 2.0 and a temperature of 40° C., and the chromate coating guard coating of sample No. 29 of Example 2 were formed. The obtained blackened steel sheets were evaluated, and the results are shown in Table 3.

Sample No. 38 was the sample of the present invention wherein thiourea was used as the thio compound and sample No. 39 was the sample of the present invention where sodium chlorate was used as the oxidative ion source, and each sample showed good results. Sample Nos. 40 through 43 were the samples of the present invention where four thio compounds were used, respectively. These samples had a largest L value than those of the samples where NaSCN or thiourea was used, and the quality was practically satisfactory. Sample No. 44 was the sample of the present invention where the blackening solution of the $Zn^{2+}$-$Ni^{2+}$-$Co^{2+}$ type was used, and the sample showed good results.

TABLE 3

| Sample No. | Blackening Solution (g/l) Base Solution | Oxidizing Ion | | Thio Compound | | L Value | Adhesion | Evenness | Chromate Coating | Guard Coating | Remarks |
|---|---|---|---|---|---|---|---|---|---|---|---|
| 38 | ZN—NI | $NaNO_3$ | 2.5 | Thiourea | 1.0 | 13 | o | o | Same as those of sample No. 29 of Example 9 | | Present invention |
| 39 | " | $NaClO_4$ | 2.5 | NaSCN | 1.0 | 11 | o | o | | | Present invention |

TABLE 3-continued

| Sample No. | Blackening Solution (g/l) Base Solution | Oxidizing Ion | | Thio Compound | | L Value | Adhesion | Evenness | Chromate Coating | Guard Coating | Remarks |
|---|---|---|---|---|---|---|---|---|---|---|---|
| 40 | " | $NaNO_3$ | 2.5 | $H_2S_2O_2$ | 1.0 | 16 | o | o | | | Present invention |
| 41 | " | " | 2.5 | $H_2S_2O_3$ | 1.0 | 15 | o | o | | | Present invention |
| 42 | " | " | 2.5 | Thiophene | 1.0 | 14 | o | o | | | Present invention |
| 43 | " | " | 2.5 | Thiophenol | 1.0 | 14 | o | o | | | Present invention |
| 44 | ZN—Ni—Co | $NaNO_3$ | 2.5 | NaSCN | 1.0 | 11 | o | o | | | Present invention |

EXAMPLE 4

A blackened steel sheet was prepared in the same manner as sample No. 10 of Example 8 except that an acidic aqueous solution formed by adding 2 g/l of thiourea or sodium thiosulfate instead of sodium thiocyanate. The L value (T-L) after formation of the guard coating was 15.2 when sodium thiosulfate was added, and the L value (T-L) after formation of the guard coating was 12.2 when thiourea was added. In each case, the adhesion was excellent.

EXAMPLE 5

The cathodic electrolytic treatment was carried out in a solution obtained by adding 1.0 g/l of sodium sulfite ($Na_2SO_3$) as the thio compound and 0.5 g/l of $Cr^{3+}$ as the modifying ion to an aqueous solution containing 200 g/dl of $ZnSO_4.7H_2O$, 300 g/l of $NiSO_4.6H_2O$ and 5 g/l of $NaNO_3$ and maintained at a pH value of 2.5 and a temperature of 40° C., at a current density of 20 A/dm$^2$ and an applied current quantity of 30 C/dm$^2$ by using a zinc-electroplated steel sheet (EG), a tin-plated steel sheet (TS) or a zinc/nickel alloy-plated steel sheet (ZN-NI) as the cathode and a lead plate as the anode.

The treated steel sheet was immediately washed with water and dipped in an aqueous solution containing 10 g/l of partially reduced chromic acid ($Cr^{3+}/Cr^{6+}$ ratio=0.4/0.6), the adhering solution was removed with an air knife, and the steel sheet was immediately dried at a sheet temperature of 60° C. Then, a commercially available aqueous clear paint comprising an olefinacrylic acid and colloidal silica was coated on the steel sheet by a roll coater, to a dry coating thickness of 1 μ, and baking was carried out at a sheet temperature of 120° C.

The L value was 12 in the case of EG, 12 in the case of the TS, and 11 in the case of ZN-NI. In the adhesion test, peeling did not occur, and the evenness was good. The corrosion resistance was excellent in that, when the salt water spray test was carried out for 168 hours, no white rust or red rust was generated.

EXAMPLE 6

The electrolysis was carried out at a current density of 30 A/dm$^2$ and an applied electricity quantity of 40 C/dm$^2$ by using a zinc/nickel alloy-plated steel sheet (Ni content=11%, coating weight=20 g/m$^2$, average roughness=1.6 μ) as the cathode in an aqueous solution containing 50 g/l of $Zn^{2+}$, 70 g/l of $Ni^{2+}$, 1 g/l of $Cr^{3+}$, 4 g/l of $NO^{3-}$ and 0.7 g/l of $SO_3^{2-}$ to form a black inorganic coating in a deposition amount of 0.9 g/m$^2$. Then, an acrylic resin emulsion containing, dispersed therein, carbon black having a primary particle size of 10 to 50 nm (particle size=50 to 200 nm) in an amount of 0, 15, 20, 30 or 40 parts by weight per 100 parts by weight of the resin was coated in a dry thickness of 1±0.1 μ by a roll coater, and baking was carried out at a sheet temperature of 120° C. The amount of Cr in the black inorganic coating was 25 mg/m$^2$. The evaluation results are shown in Table 4.

TABLE 4

| Sample No. | Sorting | Black Inorganic Coating (g/m$^2$) | Resin Coating Carbon (%) | Resin Coating Thickness (μm) | Appearance Evenness | Appearance Hue | L value | G value | Reflectance | Electroconductivity | Adhesion | Scratch Resistance | Corrosion Resistance |
|---|---|---|---|---|---|---|---|---|---|---|---|---|---|
| 1 | Example | 0.9 | 0 | 1 ± 0.1 | 3 | R | 17 | 27 | 27 | $10^{K-}$ | o | 5 | 72 |
| 2 | Example | " | 15 | " | 5 | N | 14 | 9 | 8 | $0.05-1^{K}$ | o | 5 | 72 |
| 3 | " | " | 30 | " | 5 | N | 14 | 7 | 6 | $0.05-0.5^{K}$ | o | 5 | 72 |
| 4 | " | " | 20 | " | 5 | N | 14 | 18 | 8 | $0.05-1^{K}$ | o | 5 | 72 |
| 5 | " | " | 40 | " | 5 | N | 14 | 17 | 5 | $0.05-0.5^{K}$ | o | 3 | 72 |

Sample No. 1 was a sample of black fine particles free and had a reddish black appearance having a streaky unevenness and a gloss G value of 27. Sample Nos. 2 and 4 were black surface-treated steel sheets of the present invention where carbon black was incorporated in amounts of 15 and 40 parts by weight, respectively, per 100 parts by weight of the resin. From the results of sample Nos. 2 and 4, it was found that optimum results were obtained when carbon black was added in an amount of 15 to 30 parts by weight per 100-parts by weight of the resin. In sample No. 5, it was found that the scratch resistance was lowered to some extent.

EXAMPLE 7

A black electrodeposited (Example 1) coating was formed in a deposition amount of 0.9 g/m$^2$ on the surface of a zinc/nickel alloy-electroplated steel sheet (Ni content=12%, plating amount=20 g/m$^2$, average roughness = 1.5 μ) by the cathodic treatment method, and a solution containing 10 g/l of $CrO_3$ was coated on the black inorganic coating by a squeeze roll so that the deposition amount of Cr was 50 mg/m². The coated steel sheet was dried and coated with a coating liquid formed by dispersing carbon black having a primary particle size of 10 to 50 nm (particle size of 50 to 200 nm) in a resin liquid obtained by combining a commercially available polyolefin-acrylic emulsion with colloidal silica, so that the amount of carbon black was 0, 1, 5, 10, 15, 20, 30 or 40 parts by weight per 100 parts by weight of the resin, and baking was carried out at a sheet temperature of 120° C.

Figure 4:
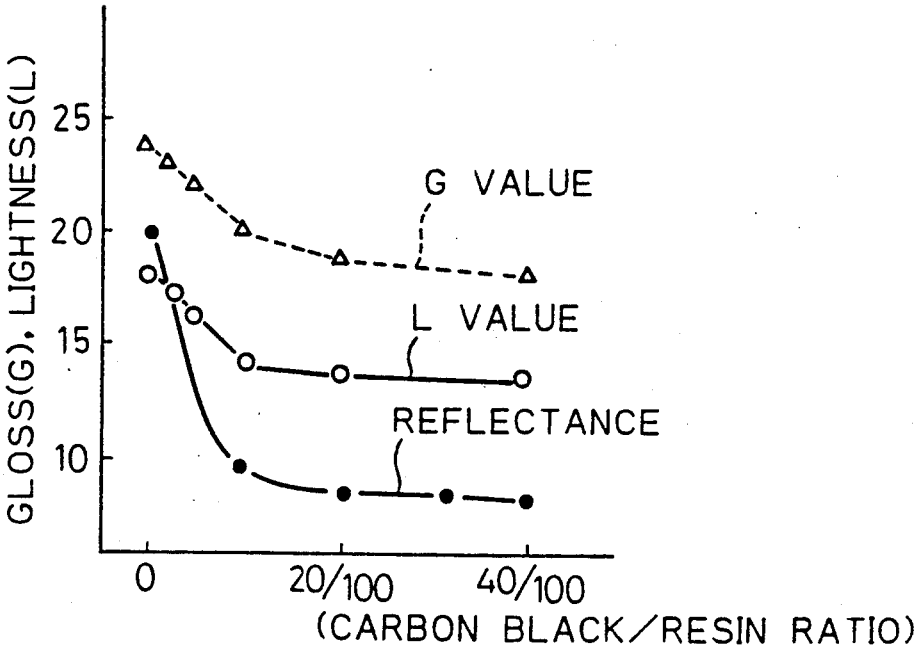
FIG. 4 is a diagram illustrating the relationship between the carbon black/resin ratio and the reflectance, gloss (G), and lightness (L); and, FIG. 5 is a diagram illustrating the relationship between the amount of carbon black added and the electric conductivity.
Figure 5:
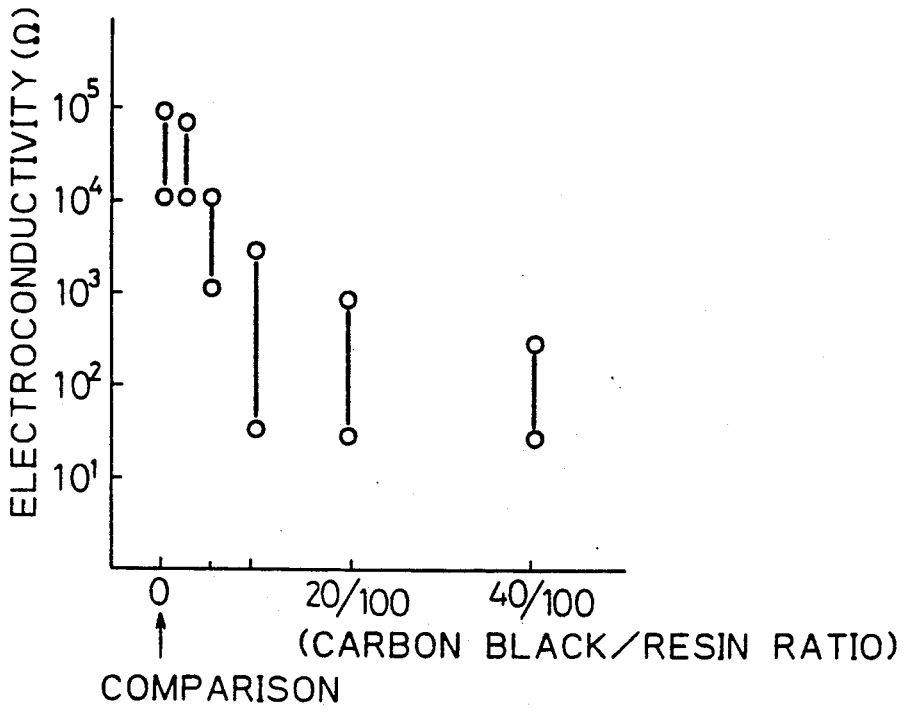

A thickness of 1 μm was desired, and from the results of the analysis of Si, it was found that the actual thickness was 1±0.1 μm. The results of the evaluation of the appearance, evenness, and scratch resistance are shown in FIG. 3, of the gloss and lightness in FIG. 4, and of the surface resistance value in FIG. 5.

Figure 3:
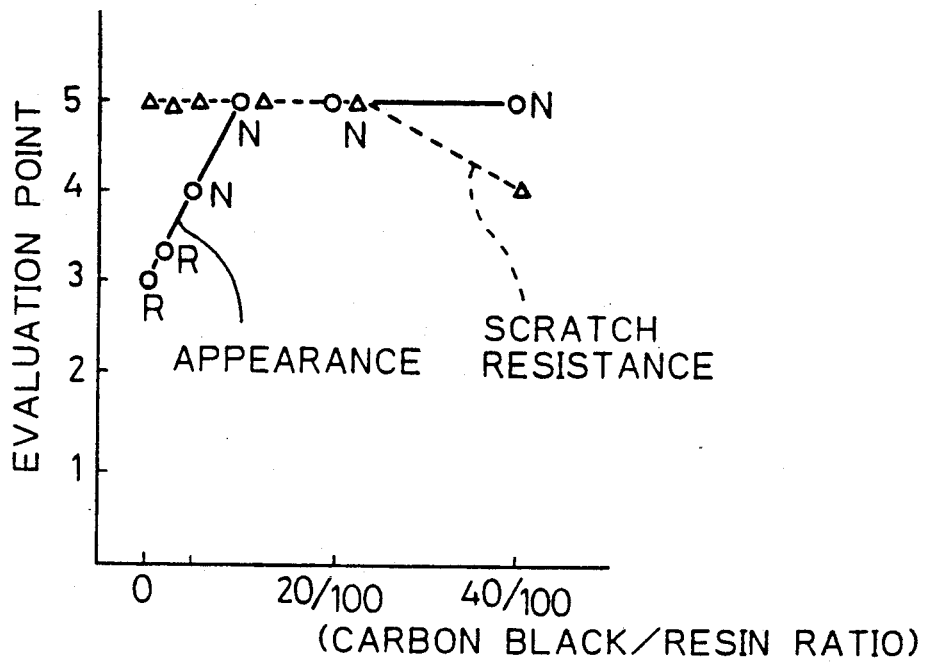
FIG. 3 is a diagram illustrating the relationship between the carbon black content in a resin coating and the evaluation point of the appearance and scratch resistance.

In the sample of carbon black free, the appearance as shown in FIG. 3 was reddish black and unevenness was observed. In contrast, at a carbon black/resin ratio of 5/100, a moderation of the surface unevenness was observed, but the unevenness was not completely eliminated. At a carbon black/resin ratio of 30/100, a good appearance was obtained. In connection with the scratch resistance shown in FIG. 3, good results were obtained, although a slight flaw was observed at the carbon black/resin ratio of 40/100. The gloss and reflectance shown in FIG. 4 were reduced by the addition of carbon black, and a semi-glossy, low-reflectance, high-grade appearance (G value of 17 to 20) was obtained. Furthermore, the lightness was reduced by the addition of carbon black and a normal black hue was obtained. The electro-conductivity shown in FIG. 5 was reduced by the addition of carbon black, and at a carbon black/resin ratio of at least 15, a low resistance value (0.05 to 1 KΩ) was obtained. In connection with the corrosion resistance, a formation of white rust was not observed over 168 hours for any of the samples, and all of the samples showed a good corrosion resistance.

alloy-plated steel sheet (Ni content = 12%, plating quantity = 20 g/m², average roughness = 1.6 μ) as the cathode, and the electrolytic chromate treatment was carried in a liquid comprising sodium chromate by using the steel sheet as the cathode. Then, the treated steel sheet was washed with water and a urethane-modified acrylic resin emulsion containing, dispersed therein, carbon black in an amount of 20 parts by weight per 100 parts by weight of the resin was coated on the treated steel sheet so that the dry coating thickness was 0.1, 0.5, 1.0, 1.5, 2.0 or 3.0 μ, and baking was carried out at a plate temperature of 120° C. Where the coating thickness was 1.0 μ, samples were prepared by changing the deposition amount of the chromate coating in the range of from 0 to 120 mg/m² as Cr, and Sample No. 13 was prepared as the comparative sample having a resin coating free of carbon black. The results are shown in Table 5.

Sample No. 7 was the sample of the present invention wherein the electrolytic chromate treatment was not carried out. Sample Nos. 8 through 12 were the samples of the present invention in which the deposition amount of the electrolytic chromate coating was 15, 30, 50, 80 or 120 mg/m² as Cr, and the thickness of the carbon black-containing resin coating was adjusted to 1±0.1 μm, and these samples all had an excellent appearance, L value, G value, and adhesion. Comparative sample No. 13 had a slightly uneven, reddish black appearance having a high gloss.

Sample Nos. 14 through 18 were the samples of the present invention where the thickness of the carbon black-incorporated resin coating was changed within the range of from 0.12 to 3.0 μm. In sample No. 14, where the thickness was small, the effect of eliminating unevenness and correcting the hue was relatively unsatisfactory, but other characteristics were good. In sample Nos. 17 and 18, where the thickness was large, the gloss tended to increase but the reflectance was low. The best results were obtained from sample Nos. 15 and 16, where the thickness of the resin coating was 0.5 to 1.5 μm.

TABLE 5

| Sample No. | Chromium Deposition Amount (mg/m²) | Resin Coating Thickness (μm) | Appearance Evenness | Appearance Hue | L Value | G Value | Electric conductivity | Adhesion | Scratch Resistance | Corrosion Resistance | Reflection |
|---|---|---|---|---|---|---|---|---|---|---|---|
| 7 | 0 | 1 ± 0.1 | 5 | N | 14.8 | 19 | 50–1000 | o | 5 | 24 | 7.5 |
| 8 | 15 | " | 5 | N | 14.6 | 19 | 50–1000 | " | 5 | 72 | 8.0 |
| 9 | 30 | " | 5 | N | 14.5 | 19 | 50–1000 | " | 5 | 168 | 8.0 |
| 10 | 50 | " | 5 | N | 14.8 | 19 | 50–1000 | " | 5 | " | 8.1 |
| 11 | 80 | " | 5 | N | 14.9 | 19 | 50–1000 | " | 5 | " | 7.5 |
| 12 | 120 | " | 5 | N | 15.0 | 19 | 100–1000 | " | 5 | 240 | 8.2 |
| 13 | 50 | clear 1 ± 0.1 | 4 | R | 14.6 | 30 | 200–1000 | " | 5 | 48 | 24.0 |
| 14 | 50 | 0.12 | 4 | R | 16.0 | 17 | 20 | " | 5 | 168 | 4.2 |
| 15 | " | 0.5 | 5 | N | 14.9 | 17 | 20–1000 | " | 5 | " | 4.1 |
| 16 | " | 1.5 | 5 | N | 13.2 | 19.5 | 100–1000 | " | 5 | " | 9.0 |
| 17 | " | 2.2 | 5 | N | 13.1 | 20 | 1000– | " | 4 | " | 9.0 |
| 18 | " | 3.0 | 5 | N | 13.1 | 25 | 1000– | " | 4 | " | 9.0 |

In connection with the adhesion, peeling was not observed in the Erichson test, and it was confirmed that the adhesion was good.

EXAMPLE 8

A black inorganic coating 1.5 g/m² was formed by carrying out the electrolysis (DK 30 A/dm², 40 C/dm²) in a sulfuric acid acidic aqueous solution (pH = 2.0) containing $Zn^{2+}$ 30 g/l, $Ni^{2+}$ 45 g/l, $Cr^{3+}$ 0.5 g/l, $NaNO_3$ 5 g/l and $Na_2SO_3$ g/l by using a zinc/nickel

EXAMPLE 9

A cold-rolled steel sheet (CR), a zinc-hot-dipped steel sheet, and a zinc/aluminum alloy-hot-dipped steel sheet (ZA) (the average roughness of the starting sheet was adjusted to 1.5 to 1.7 μ) were subjected to the cathodic electrolytic treatment (40 A/dm², 40 C/dm²) in an acidic aqueous solution containing 50 g/l of $Zn^{2+}$, 70 g/l of $Ni^{2+}$, 0.5 g/l of $Cr^{3+}$, 4 g/l of $NO_3^-$ and 0.8 g/l of $SO_3^{2-}$ to form an black coating (L value of 16 to 18) in a deposition amount of 0.8 g/m$^2$. Then, the cathodic electrolytic treatment was carried out in an aqueous solution containing 50 g/l of $Na_2Cr_2O_7$ and 0.5 g/l of $H_2SO_4$ and having a pH value of 2.0 (5 A/dm$^2$, 20 C/dm$^2$). The total Cr deposition amount inclusive of the amount of Cr in the plating layer was 90 to 100 mg/m$^2$. An acrylic resin emulsion containing carbon black (particle size of 50 to 200 nm) at a carbon black/resin weight ratio of 20/100 was then coated on the treated steel sheet so that the thickness of the dry coating was 1.5 μ, and baking was carried out at a sheet temperature of 120° C. For comparison, the resin coating was similarly formed without the addition of carbon black. The thickness of the resin coating was measured by the weight method (specific gravity=1.2). The results are shown in Table 6.

Sample Nos. 19 and 20 shown in Table 3 demonstrate the effect of an addition of carbon black. Namely, sample No. 20 had a superior appearance evenness, gloss (G value), and reflectance to sample No. 19. Sample No. 21 and 22 were those prepared by using the zinc-hot-dipped steel sheet, and sample No. 22 had a superior evenness, and scratch resistance to sample No. 21, and the reflectance and gloss of sample No. 22 were lower than those of sample No. 21. Sample Nos. 23 and 24 were prepared by using the zinc/aluminum alloy-hot-dipped steel sheet, and sample No. 24 had a lower reflectance and gloss than sample No. 23, and sample No. 24 had a superior scratch resistance and appearance to sample No. 23.

TABLE 6

| Sample No. | Starting Steel Sheet | Resin Coating | Coating Thickness (μ) | Appearance Evenness | Appearance Hue | L Value | G Value | Adhesion | Scratch Resistance | Corrosion Resistance | Reflectance |
|---|---|---|---|---|---|---|---|---|---|---|---|
| 19 | CR | Carbon black not added | 1.5 | 4 | R | 15.0 | 30 | o | 5 | 168 | 26 |
| 20 | " | Carbon black added | 1.6 | 5 | N | 14.6 | 19 | o | 5 | " | 8 |
| 21 | GI | Carbon black not added | 1.5 | 4 | N | 14.9 | 29 | o | 4 | 168 | 26 |
| 22 | " | Carbon black added | 1.5 | 5 | N | 14.6 | 19 | o | 5 | " | 9 |
| 23 | ZA | Carbon black not added | 1.4 | 4 | N | 14.2 | 32 | o | 4 | 240 | 24 |
| 24 | " | Carbon black added | 1.5 | 5 | N | 14.6 | 19 | o | 5 | " | 8 |

EXAMPLE 10

In the same manner as described in Example 9, a 10% Ni/Zn alloy-plated steel sheet was subjected to the blackening treatment and chromate treatment, and an epoxy resin containing silver oxide, nickel sulfide, iron oxide or carbide having a particle size of about 100 nm as black fine particles in an amount of 20 parts by weight per 100 parts by weight of the resin was coated in a thickness of 3 μ on the treated steel sheet, and baking was carried out at a plate temperature of 150° C. The evaluation point of the appearance evenness of each sample was 4, and the L values were 16.0, 14.0, 17.0 and 17.0, respectively. The reflectance was in the range of 6 to 9 and the gloss was in the range of 11 through 13. Each product had a low gloss.

EXAMPLE 11

In the same manner as described in Example 9, a 10% Ni/Zn alloy-plated steel sheet was subjected to the blackening treatment and chromate treatment, and an aqueous emulsion formed by incorporating and dispersing in an acrylic resin emulsion carbon black having an average particle size of 5, 50, 100, 200 or 500 nm in an amount of 25 parts by weight per 100 parts by weight of the resin was coated on the treated steel sheet so that the dry coating thickness was 1.5 μm, and baking was carried out at a plate temperature of 120° C. In the sample where carbon black having an average particle size of 50 nm was incorporated, streaky unevenness was observed in the appearance, but other samples had a good appearance. In each sample, the L value was in the range of 14 to 15 and a satisfactory black appearance was obtained. The reflectance was reduced with an increase of the particle size. Namely, the particle sizes of 5, 50, 100, and 200 nm gave reflectances of 27, 25, 22, and 9, respectively. The gloss (G value) was reduced and the appearance became semi-glossy with an increase of the particle size. Namely, the particle sizes of 5, 50, 100, 200, and 500 nm gave gloss values of 30.0, 19.9, 17.1, 16.5, and 15.2, respectively. The evaluation point of the scratch resistance of the sample wherein carbon black having a particle size of 500 nm was incorporated was 2, and this sample was inferior to other samples (evaluation points of 4 and 5).

We claim:

1. A black surface treated steel sheet or plated steel sheet, which comprises a composite electroplated coating formed in a deposition amount of 0.1 to 3 g/m$^2$ on the surface of the steel sheet or plated steel sheet;

said composite electroplated coating containing a first member selected from a group consisting of at least one of metal oxides and metal hydrous oxides, said metal being zinc and, in addition to zinc, at least one of Ni, Co, Fe, and Cr; and in addition to said first member, said composite electroplated coating contains a sulfur compound.

2. A black surface treated steel sheet or plated steel sheet, which comprises a composite electroplated coating formed in a deposition amount of 0.1 to 3 g/m$^2$ on the surface of the steel sheet or plate steel sheet;

said composite electroplated coating containing a first member selected from a group consisting of at least one of metal oxides and metal hydrous oxides, said metal being zinc and, in addition to zinc, at least one Ni, Co, Fe, and Cr; and in addition to said first member, said composite electroplated coating contains a sulfur compound;

a chromate coating formed in a deposition amount of 10 to 100 mg/m$^2$ as Cr disposed on said composite electroplated coating; and a protective coating having a thickness of 0.1 to 3 um disposed on said chromate coating.

3. A black surface-treated steel sheet as set forth in claim 2, wherein the sulfur compound is at least one member selected from the group consisting of sulfides, sulfates and sulfites.

4. A black surface-treated steel sheet as set forth in claim 2, wherein the protective coating is an organic resin coating containing, dispersed therein, an oxide having an average particle size of 1 to 100 nm.

5. A black surface-treated steel sheet as set forth in claim 2, wherein the protective coating is an acrylic resin coating containing, dispersed therein, an oxide having an average particle size of 1 to 100 nm.

6. A black surface-treated steel sheet as set forth in claim 2, wherein the protective coating is an organic resin coating having a thickness of 0.1 to 3 μm, in which black fine particles are dispersed in an amount of 15 to 40 parts by weight per 100 parts by weight of the organic resin.

7. A black surface-treated steel sheet as set forth in claim 2, wherein the protective coating is an organic resin coating having a thickness of 0.1 to 3 μm, in which black fine particles having an average particle size of 50 to 200 nm are dispersed in an amount of 15 to 40 parts by weight per 100 parts by weight of the organic resin.

* * * * *

UNITED STATES PATENT AND TRADEMARK OFFICE
CERTIFICATE OF CORRECTION

PATENT NO. : 5,023,146

DATED : June 11, 1991

INVENTOR(S) : K. Saito, et al.

It is certified that error appears in the above-identified patent and that said Letters Patent is hereby corrected as shown below:

Column 1, line 27, change "has" to --have--.

Column 1, line 38, change "demanded" to --demand--.

Column 1, line 65, change "stationally" to --stationary--.

Column 2, line 20, before "Zn-Ni" insert --a--.

Column 2, line 20, before "cathodic" insert --a--.

Column 3, line 2, change "desirably" to --desirable--.

Column 4, line 9, change "sheet FIG. 1A" to --sheet. FIG. 1A--.

Col. 4, line 26, change "Ni O," to --NiO,--.

Column 8, line 13, delete "is" before "occurs".

Column 8, line 57, change "sulfites" to --sulfite--.

Column 9, line 46, change "electrolyte" to --electrolytes--.

Column 10, line 13, insert a comma after "sheet".

UNITED STATES PATENT AND TRADEMARK OFFICE

CERTIFICATE OF CORRECTION

PATENT NO. : 5,023,146

DATED : June 11, 1991

INVENTOR(S) : K. Saito, et al.

It is certified that error appears in the above-identified patent and that said Letters Patent is hereby corrected as shown below:

Column 10, line 60, change "compound" to --compounds--.

Column 16, line 19, change "largest" to --larger--.

Column 21, line 1, change "an black" to --a black--.

Signed and Sealed this

Thirtieth Day of March, 1993

*Attest:*

STEPHEN G. KUNIN

*Attesting Officer*

*Acting Commissioner of Patents and Trademarks*